United States Patent [19]

Kellner

[11] 4,022,418

[45] May 10, 1977

[54] READING STAND

[76] Inventor: Sam J. Kellner, 315 E. 69th St., New York, N.Y. 10021

[22] Filed: Feb. 9, 1976

[21] Appl. No.: 656,173

[52] U.S. Cl. ..... 248/460

[51] Int. Cl.[2] ..... A47B 97/04

[58] Field of Search ..... 248/445, 460, 463, 464, 248/465

[56] References Cited

UNITED STATES PATENTS

| | | | |
|---|---|---|---|
| 1,790,487 | 1/1931 | Ruhnau | 248/451 |
| 2,070,940 | 2/1937 | Duchan | 248/460 |
| 2,485,517 | 10/1949 | Vaule et al. | 248/464 |
| 3,652,051 | 3/1972 | McFarlane | 248/464 X |
| 3,799,488 | 3/1974 | Sena | 248/460 X |
| 3,937,435 | 2/1976 | Roberts | 248/464 |

FOREIGN PATENTS OR APPLICATIONS

| | | | |
|---|---|---|---|
| 8,172 | 4/1909 | United Kingdom | 248/463 |
| 1,321,113 | 3/1973 | United Kingdom | 248/460 |

*Primary Examiner*—William H. Schultz
*Attorney, Agent, or Firm*—Bernard Ouziel

[57] ABSTRACT

A portable reading stand constructed from a U-shaped member stacked within a larger U-shaped member with a hinge connecting the horizontal portions of each member to permit rotation therebetween and a table hinged to the larger member for supporting books, periodicals and other reading materials of various sizes. When the two U-shaped members are separated, the stand may be stably placed across a person's body lying in bed or lounging in a chair.

7 Claims, 3 Drawing Figures

READING STAND

BACKGROUND AND SUMMARY OF THE INVENTION

My invention relates generally to light-weight, highly portable reading stands that may be placed across a person's body for hands-free reading while lying in bed or lounging in a chair.

Various stands for hands-free reading exist in the art. These, however, are generally cumbersome or of complex construction. By contrast, I have invented a reading stand that folds flat for easy portability, is made from lightweight plastic sheet or other suitable construction material, and has a minimum of constituent elements for ease of operation.

Accordingly, it is an object of my invention to provide a portable, light-weight stand for hands-free reading by a person lying in bed or lounging on a chair.

Another object of my invention is to provide a reading stand as described above which is simple in construction with few constituent parts and thus inexpensive to fabricate.

Other objects and features of my invention will be apparent from the following detailed description when read together with the accompanying drawing in which.

DESCRIPTION OF THE INVENTION

Figure 1:
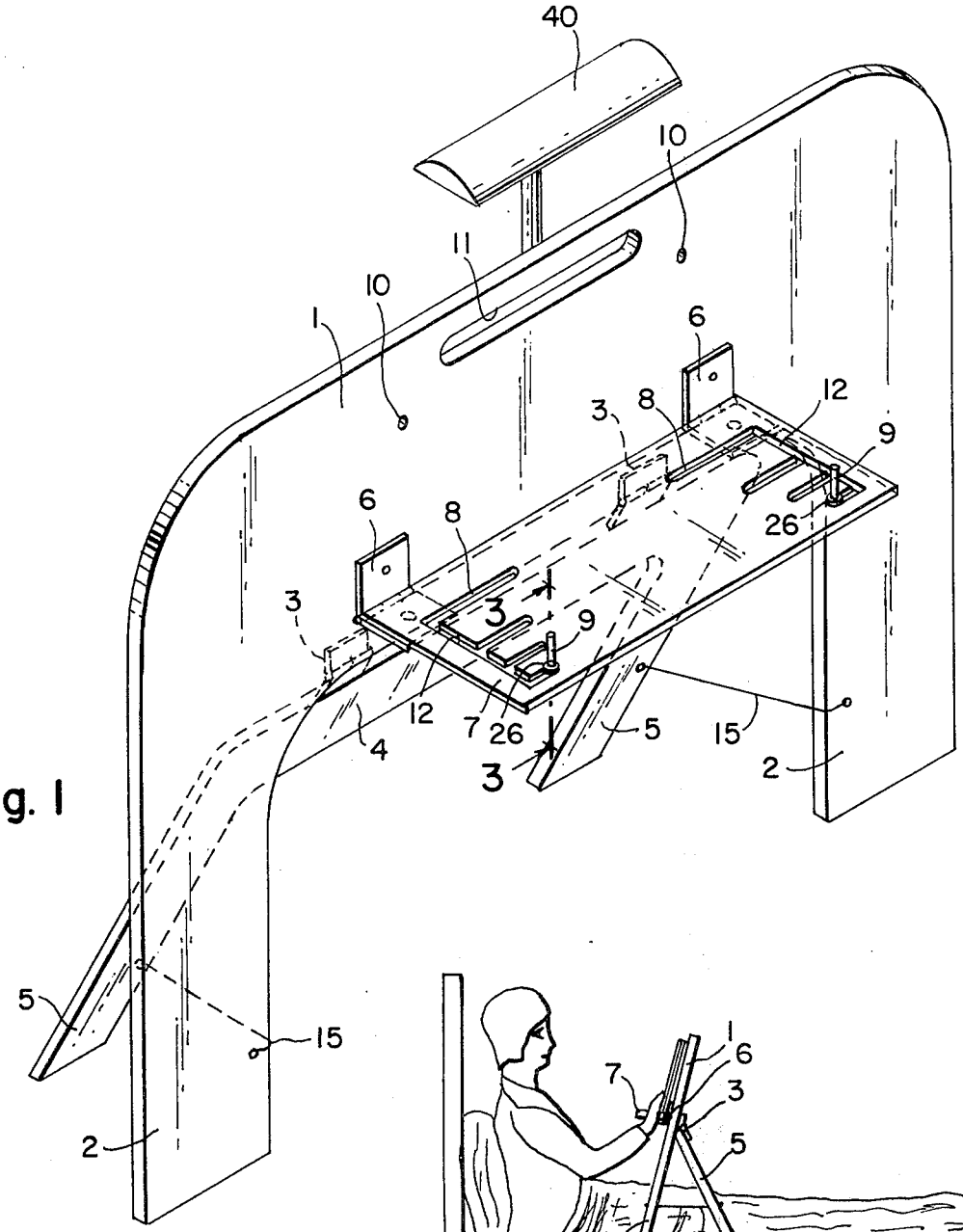
FIG. 1 is a perspective view of a preferred embodiment of a reading stand in accordance with the invention.

Referring now to FIG. 1, there is shown in detail the construction of one embodiment of the reading stand in accordance with my invention. The stand has a main and an auxilliary panel each in the shape of an inverted U constructed from a sheet of plastic, wood, metal or other suitable material.

The main panel has a horizontal cross member 1 separating a pair of vertical members 2 functioning as the front legs of the stand. One leaf of hinges 3 is mounted along the interior edge of the horizontal member of the main panel. The other leaf of hinges 3 is secured to an auxilliary U-shaped panel having a horizontal cross member 4 separating a pair of vertical legs 5. The auxilliary panel or flap is dimensional to fit within and contiguous to the inside perimeter of the main panel. In this fashion, the auxilliary panel is permitted to move so that its legs 5 can be swung to the rear of legs 2 of the main panel.

When legs 5 are so rotated, they are maintained in a fixed acute angular position relative to legs 2 by a stop on hinges 3, a string restraint 15 such as a wire, chain, or such other suitable means as is known to those versed in the art. In this position, the stand will remain stably in place across the lap of a reader.

A table 7 is fastened to cross member 1 by means of hinges 6 constructed to permit table 7 to rotate from a folded position parallel and contiguous to the plane of cross member 1 through an arc of 90° outwardly therefrom.

Figure 3:
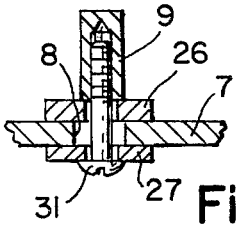
FIG. 3 is a cross section of a holding pin taken in a plane passing through lines 3—3 of FIG. 1.

Each end of table 7 is provided with a series of place channels 8 running parallel to and outwardly from the pivotal axis between table 7 and cross member 1. The channels 8 at each end may be of decreasing length and are interconnected by a common mutually perpendicular access channel 12. Located within the channels at each end of table 7 is a holding pin 9 constrained to move within the channels by washers or nuts, or such other means as is commonly known to those versed in the art, spaced apart from each other a distance to accommodate the thickness of table 7. For example, and as shown in FIG. 3, each holding pin 9 may be fastened in place by a screw 31 and a pair of washers 26 and 27 between which table 7 is sandwiched. The head of screw 31 bears upon bottom washer 27, while the threaded portion is fastened within a tapped hole of holding pin 9 separated from table 7 by top washer 26. In this fashion, each holding pin 9 may be secured in place by tightening it against screw 31 after being located at a position within the channels to accommodate books of varying thicknesses and widths.

Figure 2:
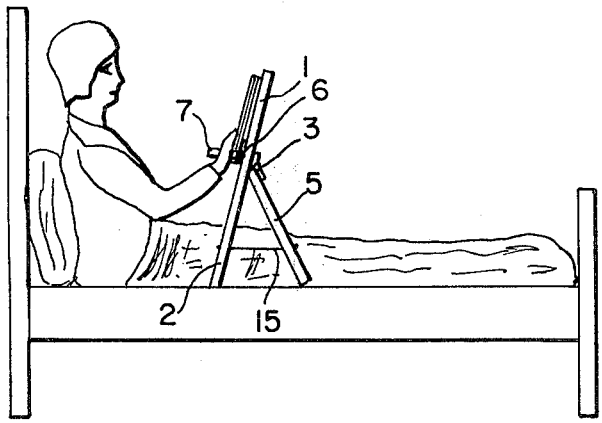
FIG. 2 is a sketch showing the stand in place across the body of a person making hands-free use of it as intended by me.

FIG. 2 shows the reading stand as used by a person reclining in a bed with a book held in place. The length of legs 5 and 2 is such as to permit a reader comfortably to read from a book placed with its binding resting against the front of cross member 1 and its edge resting on the top of table 7 with pages held open to the desired place by holding pins 9 moved to appropriate positions within channels 8. Additionally, a lamp 40 may be mounted on the stand as shown to provide light as required.

To facilitate the portability of the stand, holes 10 are cut into the cross member 1 with a diameter and at a point designed to accept the passage of dowels 9 therethrough when table 7 is folded up against cross member 1. Additionally, channel 11 is cut near the top of cross member 1 with dimensions sufficient to permit the fingers of a hand to fit therethrough for gripping the stand and transporting it from place to place.

It is to be understood that the above-described arrangements are illustrative of the application of the principals of the invention. Numerous other arrangements may be devised by those skilled in the art without departing from the spirit and scope of the invention.

I claim:

1. A reading stand comprising a U-shaped main panel having a parallel pair of legs spaced apart by a cross member, a table for supporting reading material, table fastening means coupling said table to said cross member to permit angular movement of said table forward of said main panel, a U-shaped flap having a parallel pair of legs spaced apart by a cross member fashioned to fit within and contiguous to the interior of said U-shaped main panel, said cross member of said flap being disposed contiguous to said cross member of said main panel, and means for fastening said cross members of said flap and main panel to permit angular movement of said flap to a fixed position rearward of said main panel.

2. A reading stand in accordance with claim 1 wherein each end of said table has a holding means comprising a series of place channels cut parallel to said cross member, an access channel in each end of said table interconnecting said place channels and a holding pin at each end of said table constrained for movement within said place and access channels.

3. An adjustable portable stand in accordance with claim 2 wherein a first washer is placed between said holding pin and the upper face of said table over a channel, a second washer is placed on the lower face of said table opposite said first washer, and wherein a screw having a head bearing upon said second washer and a shank passing through said washers is threaded into a hole tapped axially in said holding pin to permit said holding pin to be adjustably tightened in place.

4. A reading stand in accordance with claim 2 wherein said table fastening means includes hinge means having a stop to permit rotation through a right angle.

5. A reading stand in accordance with claim 4 wherein said flap fastening means includes hinge means having a stop to permit rotation of said flap to an acute angle with said main panel.

6. A reading stand in accordance with claim 4 wherein said flap fastening means includes a pair of string restraints each of which is fastened at one end to said flap and the other end to said main panel.

7. A reading stand in accordance with claim 5 wherein said cross member has an aperture dimensioned to accept and disposed opposite a selected position for each of said holding pins when said table is folded against said cross member and wherein a channel dimensioned to accept a human hand is cut in said cross member parallel to and opposite the pivotal axis of said table.

* * * * *